US009550388B2

(12) United States Patent
Petersen

(10) Patent No.: US 9,550,388 B2
(45) Date of Patent: Jan. 24, 2017

(54) METHOD AND SYSTEM FOR SELF-INKING STAMP CARTRIDGE

(71) Applicant: Millennium Marking Company, Elk Grove Village, IL (US)

(72) Inventor: Craig J. Petersen, Park Ridge, IL (US)

(73) Assignee: Trodat GmbH (AT)

( * ) Notice: Subject to any disclaimer, the term of this patent is extended or adjusted under 35 U.S.C. 154(b) by 311 days.

(21) Appl. No.: 13/646,115

(22) Filed: Oct. 5, 2012

(65) Prior Publication Data

US 2014/0096695 A1 Apr. 10, 2014

(51) Int. Cl.

| | |
|---|---|
| ***B41K 1/38*** | (2006.01) |
| ***B41K 1/50*** | (2006.01) |
| ***B41K 1/00*** | (2006.01) |
| ***B41K 1/54*** | (2006.01) |

(52) U.S. Cl.

CPC . *B41K 1/00* (2013.01); *B41K 1/38* (2013.01); *B41K 1/50* (2013.01); *B41K 1/54* (2013.01)

(58) Field of Classification Search

CPC ..... B41K 1/38; B41K 1/40; B41K 1/42; B41K 1/50

USPC ..... 101/327, 333

See application file for complete search history.

(56) References Cited

U.S. PATENT DOCUMENTS 3,402,663 A * 9/1968 Takaji Funahashi .... B41K 1/38 101/327
3,855,925 A * 12/1974 Funahashi ..... 101/333
5,996,493 A * 12/1999 Okumura et al. ..... 101/333
6,000,335 A * 12/1999 Imamaki et al. ..... 101/327
6,164,202 A * 12/2000 Takami ..... 101/405
D474,494 S 5/2003 Petersen et al.
6,739,255 B2 * 5/2004 Blees et al. ..... 101/327
6,892,637 B2 5/2005 Petersen
6,968,781 B1 11/2005 Petersen
7,073,437 B2 7/2006 Petersen
7,077,063 B2 7/2006 Petersen
7,096,785 B2 8/2006 Petersen
7,124,684 B1 10/2006 Petersen
7,506,582 B2 3/2009 Petersen

OTHER PUBLICATIONS

Millennium Marking Price List Catalog, Jan. 2011.

* cited by examiner

*Primary Examiner* — Jennifer Simmons
*Assistant Examiner* — Leo T Hinze
(74) *Attorney, Agent, or Firm* — Lerner, David, Littenberg, Krumholz & Mentlik, LLP

(57) ABSTRACT

An example ink cartridge for a stamp may comprise an image-forming component, a first ink-storage component made of an ink-absorbent material, a second ink-storage component made of an ink-absorbent material having one or more channels in it, and a frame made of a rigid, non-ink-absorbent material. The frame may comprise a floor having one or more holes in it. The frame may comprise an outer wall along its perimeter. The outer wall may extend up from the floor such that the outer wall is capable of retaining ink while the ink is being absorbed by the first ink-storage component and the second ink-storage component, thereby increasing the effective volume of the channel(s). The one or more holes may align with the one or more channels such that ink is enabled to flow through the hole(s) into the channel(s).

20 Claims, 11 Drawing Sheets

METHOD AND SYSTEM FOR SELF-INKING STAMP CARTRIDGE

TECHNICAL FIELD

Aspects of the present disclosure relate to ink stamps. More specifically, to a method and system for a self-inking stamp cartridge.

BACKGROUND

Existing methods and systems for ink stamps are often inefficient in terms of the processes and materials required for manufacturing them. Furthermore, existing methods and systems for ink stamps are often inefficient in terms of the need for frequent refilling and the manner of refilling. Further limitations and disadvantages of such methods and systems will become apparent to one of skill in the art, through comparison of such methods and systems with aspects of the method and system set forth in the remainder of the present disclosure with reference to the drawings.

BRIEF SUMMARY

A method and/or system is provided for a self-inking stamp cartridge, substantially as illustrated by and/or described in connection with at least one of the figures, as set forth more completely in the claims.

DETAILED DESCRIPTION

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "e.g.," and "for example" introduce a list of one or more non-limiting examples, instances, or illustrations.

Figure 1A:
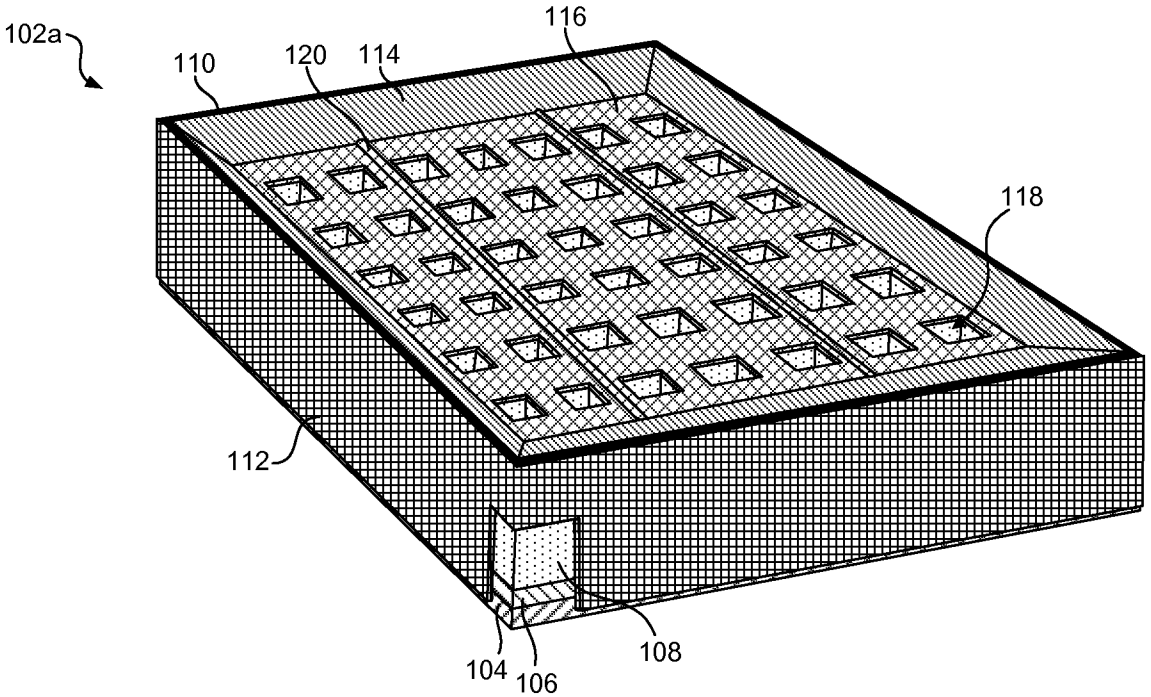
FIG. 1A depicts a 3-D view of an ink cartridge in accordance with an example implementation of the present disclosure.
Figure 1B:
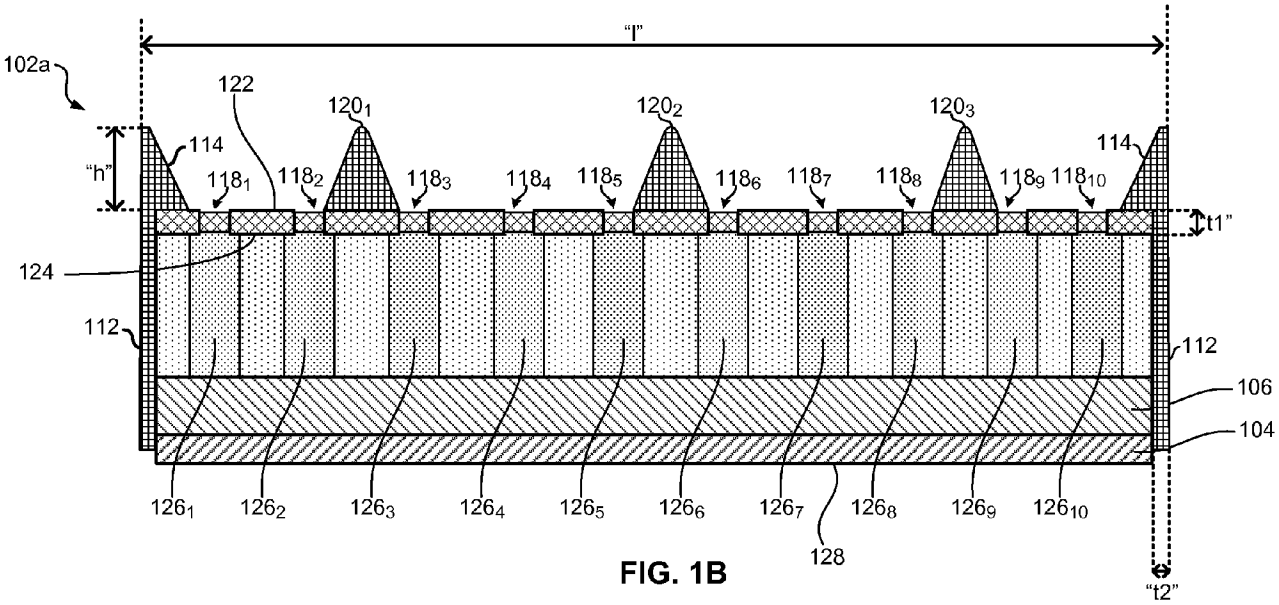
FIG. 1B depicts a cross-sectional view of an ink cartridge in accordance with an example implementation of the present disclosure.

FIGS. 1A and 1B depict an ink cartridge in accordance with an example implementation of the present disclosure. The ink cartridge 102*a* shown in FIG. 1A (3-D view) and FIG. 1B (cross-section) is one example implementation of an ink cartridge that may utilize aspects of the present disclosure. The example ink cartridge 102*a* comprises an image-forming component 104, a first ink-storage component 106, a second ink-storage component 108, and a frame 110. In FIG. 1A, the components 104, 106, and 108 are made visible via a cut-away of the frame 110.

The image-forming component 104 may comprise an image surface 128 (FIG. 1B). When the ink cartridge 102*a* is loaded with ink and the image surface 128 is pressed against paper (or some other surface to be stamped), the image in/on the image surface 128 may be transferred to the paper. The image-forming component 104 may be made from a porous soft resin in which optical energy absorbing material is dispersed. To produce an image onto the image surface 128, a transparent film having the positive image to be created is placed against the image surface 128. The positive image may be comprised of black and clear areas. With the transparent film with the image thereon against the image surface 128, the ink cartridge 102*a* (or some portion thereof comprising the image-forming component 104) is placed in a sealed light box with the image surface 128 pressed against a clear glass or plastic member. A xenon light is placed in the light box below the image surface 128 and energized for a predetermined time. The rays from the xenon light irradiate the image surface 128 through the transparent film wherever there were clear image areas on the film. This causes a chemical reaction fusing the resin from the heat. This seals the portions of the image surface 128 which were not shielded from the light by the black areas of the image on the film, resulting in areas that are non-permeable to the ink passing through the image forming component 104. The rays do not penetrate the black image areas on the film and thus no reaction occurs on the image surface 128. These areas remain unsealed and thus ink permeable. Thus, the image is transferred from the film to the image surface 128. In other implementations of the image-forming component 104, other methods of forming an image in/on the image surface 128 may be used to form ink permeable and ink impermeable areas to define the image.

The first ink-storage component 106 may be made of an ink-absorbent material (e.g., foam) such that ink poured onto the first ink-storage component 106, or ink draining onto the first ink-storage component 106 from the second ink-storage component 108, is absorbed by the first ink-storage component 106. Ink absorbed by the first ink-storage component 106 may drain onto the image-forming layer 104. In this manner, the first ink-storage component 106 may serve to hold ink until the ink is needed for stamping, without the ink being free-flowing such that it may run or drip from the cartridge 102*a*.

The second ink-storage component 108 may be made of an ink-absorbent material (e.g., foam) such that ink poured onto the second ink-storage component 108, or ink pooled in the channel(s) 126, is absorbed by the second ink-storage component 108. Ink absorbed by the second ink-storage component 108 may drain onto the first ink-storage component 106. In this manner, the second ink-storage component 108 may serve to hold ink until the ink is needed for stamping, without the ink being free-flowing such that it may run or drip from the cartridge 102*a*.

The second ink-storage component 108 may have one or more channels in it. For example, each of callouts $\mathbf{126}_1$-$\mathbf{126}_{10}$ in FIG. 1B may correspond to a separate channel or may correspond to portions of a single channel (e.g., channel 126 shown in FIG. 3B). The channel(s) 126 may be, for example, cut into the ink-storage component 108 using a cutting blade and/or a laser.

The frame 110 may provide structural support and rigidity to the ink cartridge 102*a* such that the ink cartridge 102*a* may be attached and detached from a stamp, and such that the image on the image surface 128 can be transferred to a surface by applying force to the stamp. Accordingly, the frame 110 may be made of a rigid, non-ink-absorbent material such as metal or plastic. The choice of a non-ink absorbent material may allow ink to be poured onto the frame and then drain into the ink-storage components.

The frame 110 may comprise a floor 116 having one or more holes 118 in it. The holes 118 may be uniformly distributed along a length and/or width of the floor 116. For example, in FIG. 1B the holes $\mathbf{118}_1$-$\mathbf{118}_{10}$ may be evenly distributed along the length, "l" of the cartridge 102*a*. The holes 118 may be elliptical (including circular) and/or rectangular (including square) in shape. The holes 118 may be arranged in a grid pattern.

The frame 110 may comprise an outer wall along its perimeter. The outer wall may comprise an outer surface 112 and an inner surface 114. In the example ink cartridge 102*a*, the outer wall surrounds the ink-storage components 106 and 108 and partially surrounds the ink-forming component 104. The distance that the image-forming component 104 extends below the outer wall may determine how much compression of components 104, 106, and 108 may occur during stamping (i.e., when downward force is applied to the stamp to which the cartridge 102*a* is attached).

In another example implementation, the outer wall may not extend below the surface 124 of the floor 116. An advantage of such an implementation may be that the length and/or width of the image-forming component 104, the first ink-storage component 106, and/or the second the ink-storage component 108 can be increased relative to an implementation where the components 104, 106, 108, and/or 108 need to fit within the outer wall of the frame 110. For example, relative to the implementation shown in FIGS. 1A and 1B, in an implementation where the outer wall does not surround components 104, 106, or 108, the length and/or width of the components 104, 106, and 108 may be increased by twice "t2," where "t2" is the thickness of the outer wall below the surface 124 in FIGS. 1A and 1B.

The frame 110 may comprise one or more support ribs 120 that run along the length and/or width of the floor 116. The rib(s) 120 may provide increased structural rigidity which may, for example, aid in evenly distributing pressure applied to a stamp to which the cartridge is attached. The rib(s) 120 may be sloped such that ink poured onto the rib(s) drains to the holes 118.

The frame 110 may be a single piece of injection-molded plastic. In such an implementation, the distinction between the inner surface 114 of the outer wall and the floor 116 herein may be only for purposes of description.

The non-image surface of the image-forming component 104 may be adhesively held to a first surface of the first ink-storage component 106. A second surface of the first ink-storage component 106 may be adhesively held to a first surface of the second ink-storage component 108. A second surface of the second ink-storage component 108 may be adhesively held to the surface 124 of the floor 116 of the frame 110.

The cartridge 102*a* may be loaded with ink by pouring the ink into the holes 118, onto the inner surface 114 of the outer wall, and/or onto the floor 116. In instances that the ink is poured faster than it is absorbed into the ink-storage components 106 and 108, the ink may pool in the channel(s) 126. If the volume of ink poured faster than the rate of absorption is more than can be held in the channel(s) 126, then the ink may pool within the holes 118 (the space defined by the edges of the holes 118, the distance, 't', between the top surface 122 and the bottom surface 124 of the floor 116). If the volume of ink poured faster than the rate of absorption is more than can be held in the channel(s) 126 and the holes 118, then the ink may pool above floor 116 and be retained by the outer wall. Thus, the volume of components 106 and 108, the number and/or size of holes 118, the thickness of the floor 114, the height of the outer wall; the slope of the inner surface 114, and the rate at which ink is absorbed by the components 108 and 106 may impact the amount of ink the cartridge 102*a* can hold and/or how fast ink can be poured onto the cartridge 102*a* during filling.

Figure 1C:
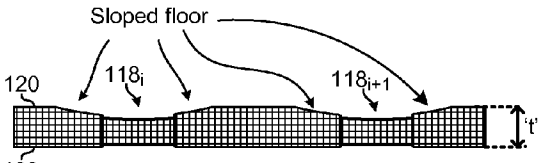
FIG. 1C depicts a cross-sectional view of an ink cartridge in accordance with an example implementation of the present disclosure.

As the ink absorbs into the components 106 and 108, the level of the pooled ink may fall and ink above the holes 118 may drain into the holes 118. Such drainage may be aided by a slope of the inner surface 114 of the outer wall (as shown in FIGS. 1A and 1B) and/or the floor 116 (as shown in FIG. 1C) that directs, with the aid of gravity, ink toward the holes 118.

In an example implementation, an ink cartridge 102 may comprise only a single ink-storage component. In an example implementation, something other than adhesive (e.g., staples, lips or ledges in the frame 110, etc.) may hold the components 104, 106, 108, and 110 together.

Figure 2:
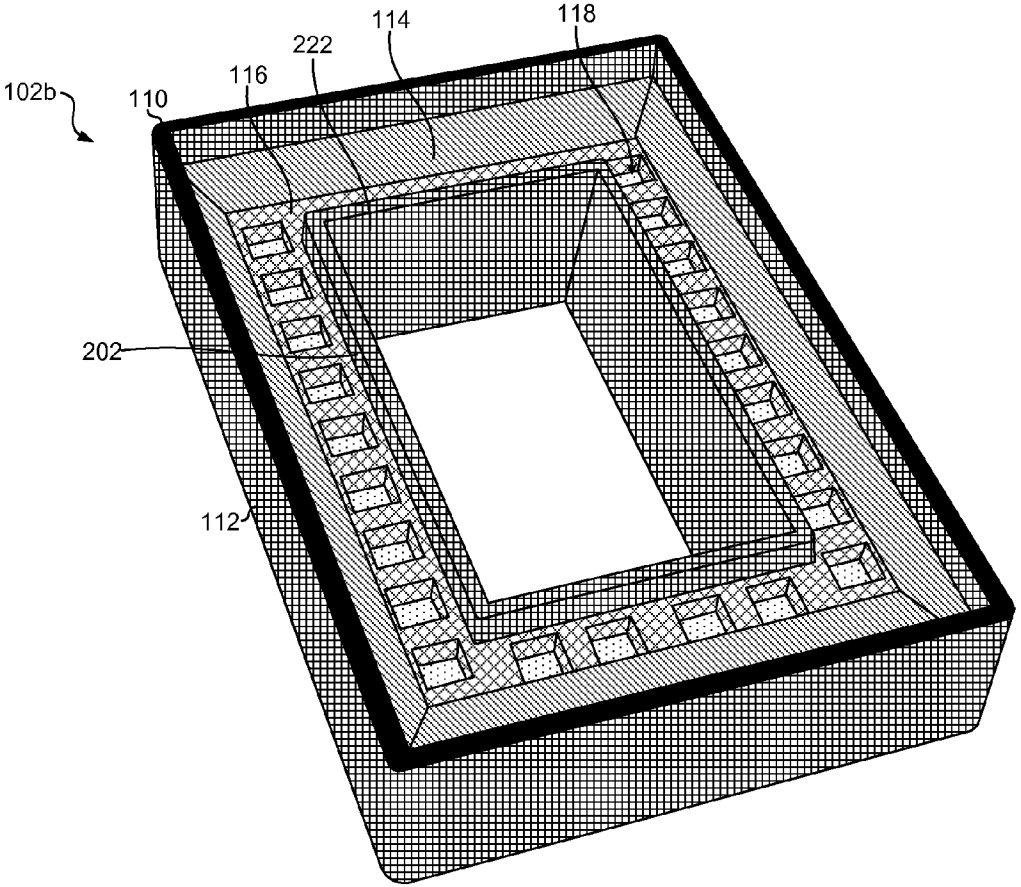
FIG. 2 depicts a 3-D view of an ink cartridge in accordance with an example implementation of the present disclosure.

FIG. 2 depicts a 3-D view of an ink cartridge in accordance with an example implementation of the present disclosure. The ink cartridge 102*b* shown in FIG. 2 is one example implementation of an ink cartridge that may possess and/or take advantage of aspects of the present disclosure. As with the example ink cartridge 102*a*, the cartridge 102*b* shown in FIG. 2 comprises the image-forming component 104, the first ink-storage component 106, the second ink-storage component 108, and the frame 110. The ink cartridge 102*b* differs from the ink cartridge 102*a* in that it is "ring" or "picture frame" shaped such that the frame 110 additionally comprises an inner wall along its inner perimeter.

The inner wall may comprise an inner surface 202 and an outer surface 222. The description of the outer wall above may be equally applicable to the inner wall. When loading ink into the cartridge, ink pooled above the top surface of the floor 116 of the frame 110, may be retained between the inner wall and the outer wall.

FIGS. 3A-3D depict components of an ink cartridge in accordance with an example implementation of the present disclosure.

Figure 3A:
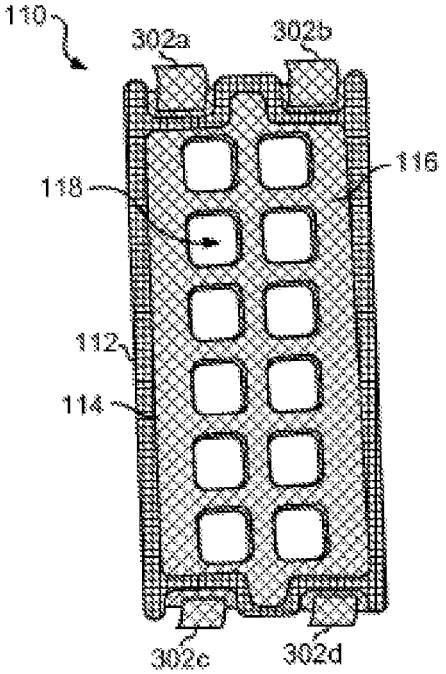
FIGS. 3A-3D depict components of an ink cartridge in accordance with an example implementation of the present disclosure.

Referring to FIG. 3A, there is shown another example implementation of the frame 110. In addition to the outer wall, the floor 116, and the holes 118 previously discussed, the frame 110 in FIG. 3A comprises clips 302*a*-302*d* for attaching the cartridge 102 to a stamp.

Figure 3B:
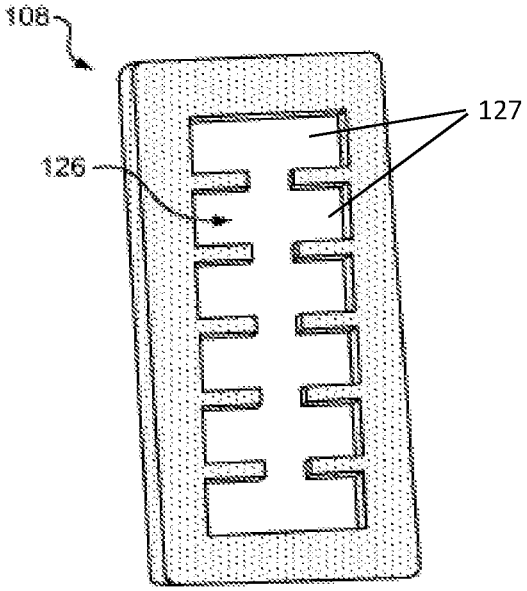

Referring to FIG. 3B, there is shown another example implementation of the second ink-storage component 108. The second ink-storage component 108 shown in FIG. 3B has a shape and size suited for use with the frame 110 shown in FIG. 3A. The ink-storage component 108 depicted in FIG.

3B has a single channel 126 in it. The shape of the channel 126 may be determined based on the method (e.g., laser) by which the channel is to be cut. For example, a channel shape which requires fewer passes of a laser may be desired. Additionally or alternatively, a channel shape and/or size may be selected to optimize a ratio between volume of pooled ink that can be held in the channel to volume of absorbed ink that can be held in the ink-storage component 108. Additionally or alternatively, shape and/or size of the channel 126 may be selected to optimize a ratio of surface area of the walls of the channel (surface area of channel walls may impact rate of ink absorption) to the volume of pooled ink that the channel 126 can hold. Additionally or alternatively, the size and/or shape of the channel 126 may be selected to optimize a trade-off between two or more of: ink absorption rate, absorbed ink volume, and pooled ink volume. In the example ink-storage component 108 of FIG. 3B, the channel 126 is "zipper" shaped. In the example shown in FIG. 3B, the ink-storage component 108 has a plurality of subchannels 127 which are open to one another, while each subchannel is partially separated from the subchannel adjacent thereto by the ink-absorbent material of the ink-storage component 108.

Figure 3C:
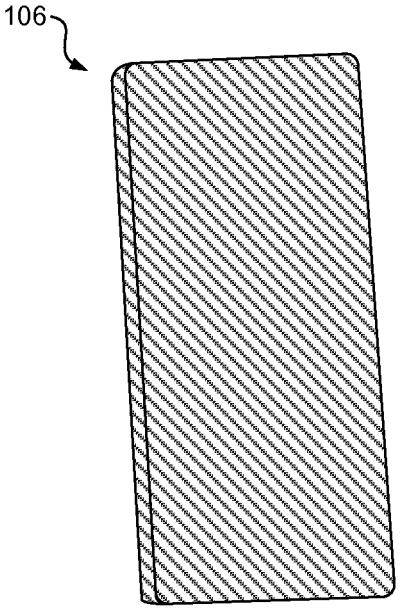

Referring to FIG. 3C, there is shown another example implementation of the first ink-storage component 106. The first ink-storage component 108 shown in FIG. 3C has a shape and size suited for use with the frame 110 shown in FIG. 3A.

Figure 3D:
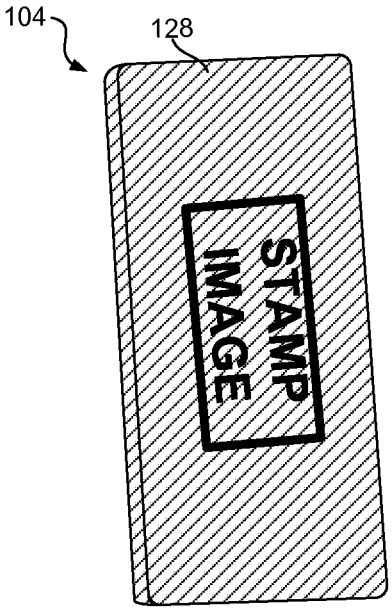

Referring to FIG. 3D, there is shown another example implementation of the image-forming component 104. The image-forming component 104 shown in FIG. 3C has a shape and size suited for use with the frame 110 shown in FIG. 3A. Also called out in FIG. 3D, is the image-surface 128.

Figure 3E:
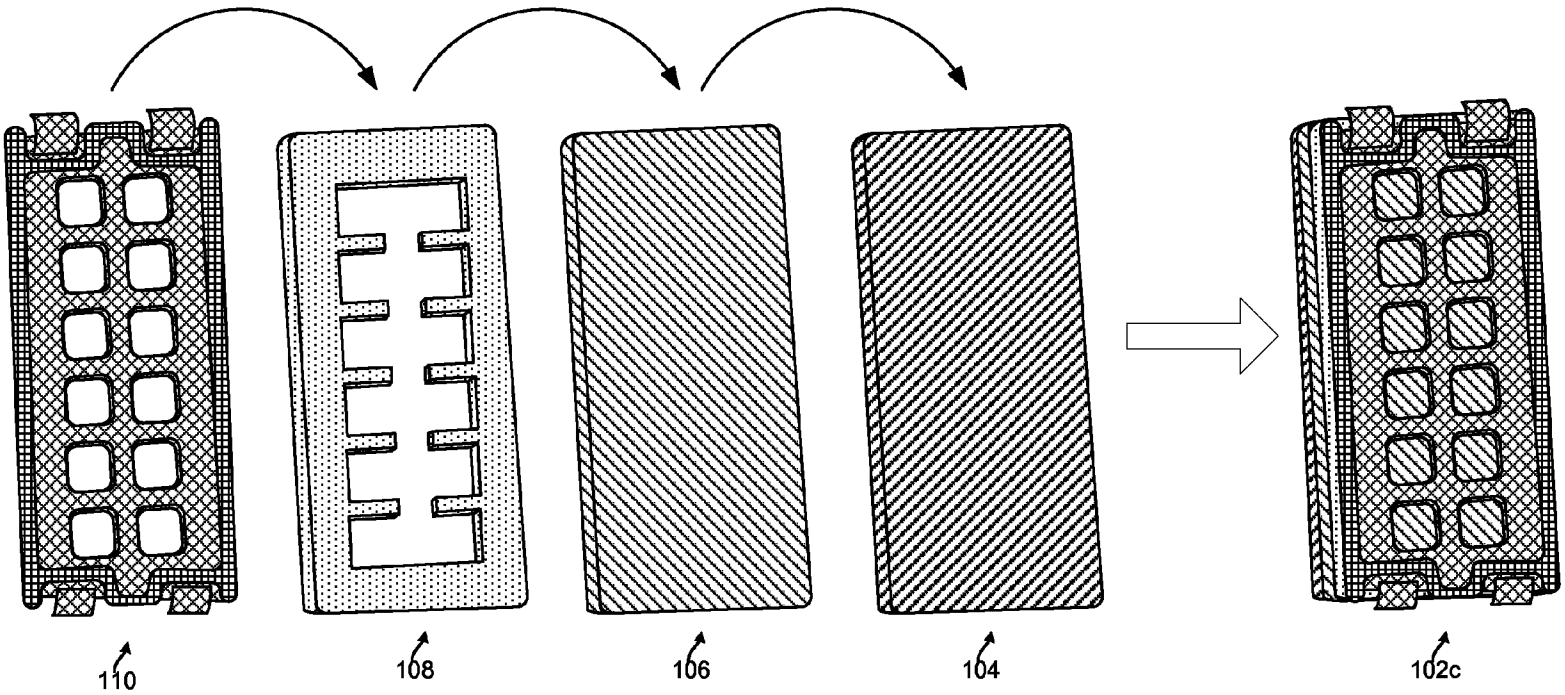
FIG. 3E illustrates assembly of an ink cartridge in accordance with an example implementation of the present disclosure.

FIG. 3E illustrates assembly of an ink cartridge in accordance with an example implementation of the present disclosure. As shown in FIG. 3E, the cartridge 102*c* may be assembled by stacking the components 104, 106, 108, and 110, with adhesive (e.g., glue or double-sized tape) between components 104 and 106, between components 106 and 108, and between components 108 and 110.

Figure 4A:
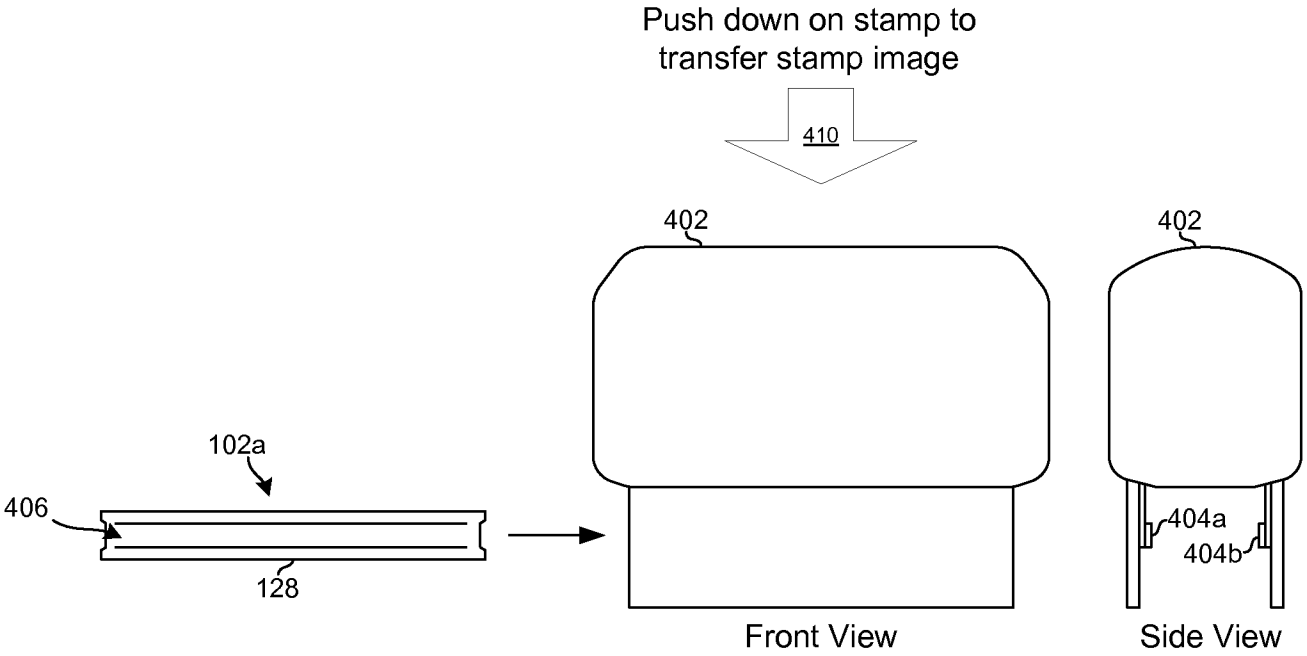
FIG. 4A illustrates attachment of an ink cartridge to a stamp in accordance with an example implementation of the present disclosure.

FIG. 4A illustrates attachment of an ink cartridge to a stamp in accordance with an example implementation of the present disclosure. Shown in FIG. 4A, is a stamp 402 to which the example ink cartridge 102*a* may be attached by sliding it into the stamp 402 from the side. In the example implementation shown in FIG. 4A, the ink-cartridge 102*a* may be retained in the stamp 402 by tongues 404*a* and 404*b* which fit into grooves 406 of the ink cartridge 102*a*. As indicated by the arrow 410, when the cartridge 102*b* is attached to the stamp 402, pressing down on the stamp 402 brings the image surface 128 down to contact the surface (e.g., paper) being stamped. In another implementation, the frame 110 may slide into a groove of the stamp 104.

Figure 4B:
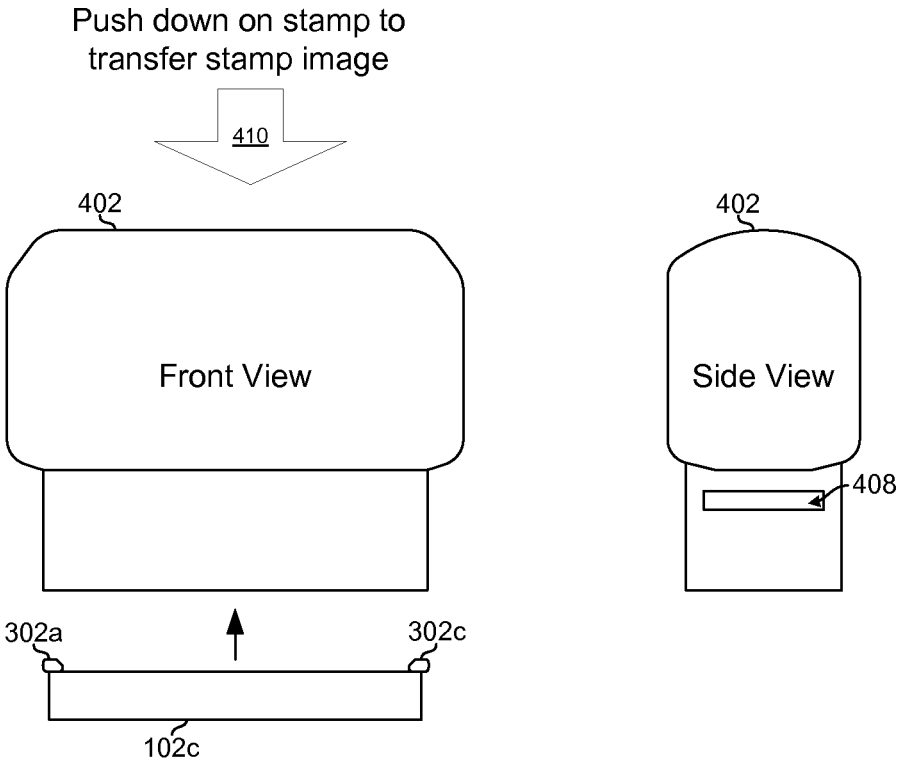
FIG. 4B illustrates attachment of an ink cartridge to a stamp in accordance with an example implementation of the present disclosure.

FIG. 4B illustrates attachment of an ink cartridge to a stamp in accordance with an example implementation of the present disclosure. Shown in FIG. 4B, is a stamp 402 to which the example ink cartridge 102*c* may be attached by sliding it into the stamp 402 from the bottom. In the example implementation shown in FIG. 4B, the ink-cartridge 102*c* may be retained in the stamp 402 by clips 302*a*-302*d* and grooves 408. As indicated by the arrow 410, when the cartridge 102*b* is attached to the stamp 402, pressing down on the stamp 402 brings the image surface 128 down to contact the surface (e.g., paper) being stamped.

Figure 5:
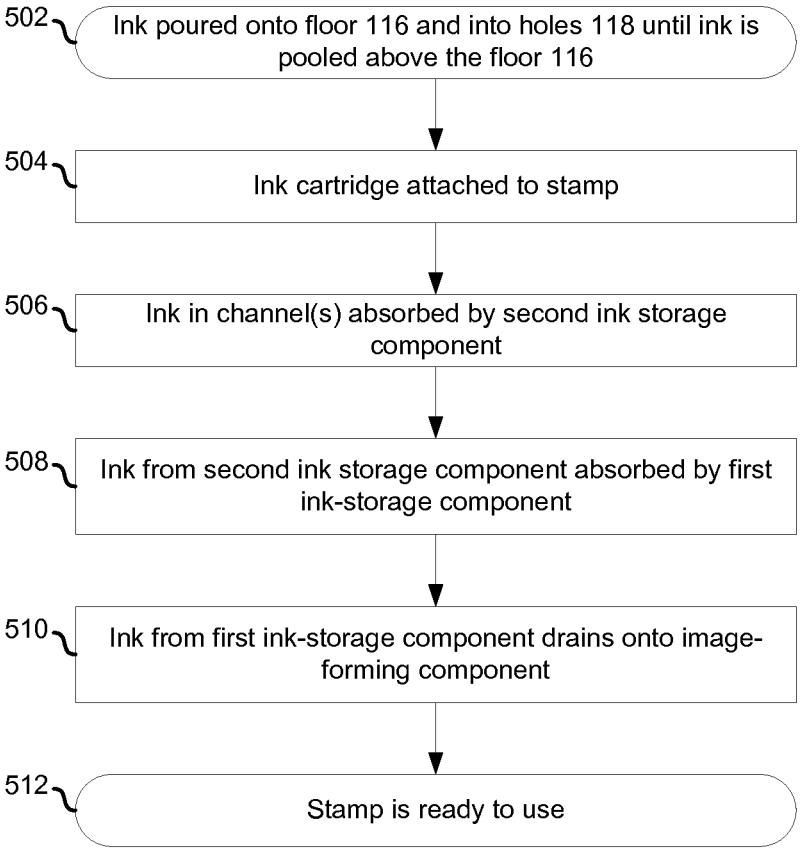
FIG. 5 is a flowchart illustrating an example process for filling an ink cartridge in accordance with an example implementation of the present disclosure.

FIG. 5 is a flowchart illustrating an example process for filling an ink cartridge in accordance with an example implementation of the present disclosure. The example process begins with step 502 in which ink is poured onto the ink cartridge 102. The ink may be poured directly into the holes 118 and/or onto the top surface 122 of the floor 116 from where it drains into the holes 118 (e.g., as a result of sloped walls, floor, and/or ribs). When the ink comes in contact with the second ink-storage component 108, it begins to absorb into the second ink-storage component 108. In step 504, the ink cartridge 102 is attached to a stamp 402. In step 506, the ink continues to absorb into the second ink-storage component 108. In step 508, ink from second ink-storage component 108 drains onto, and is absorbed by, first ink-storage component 106. In step 510, ink from the first ink-storage component 106 drains onto the image-forming component 104 such that, in step 512, the stamp is ready for use.

Figure 6A:
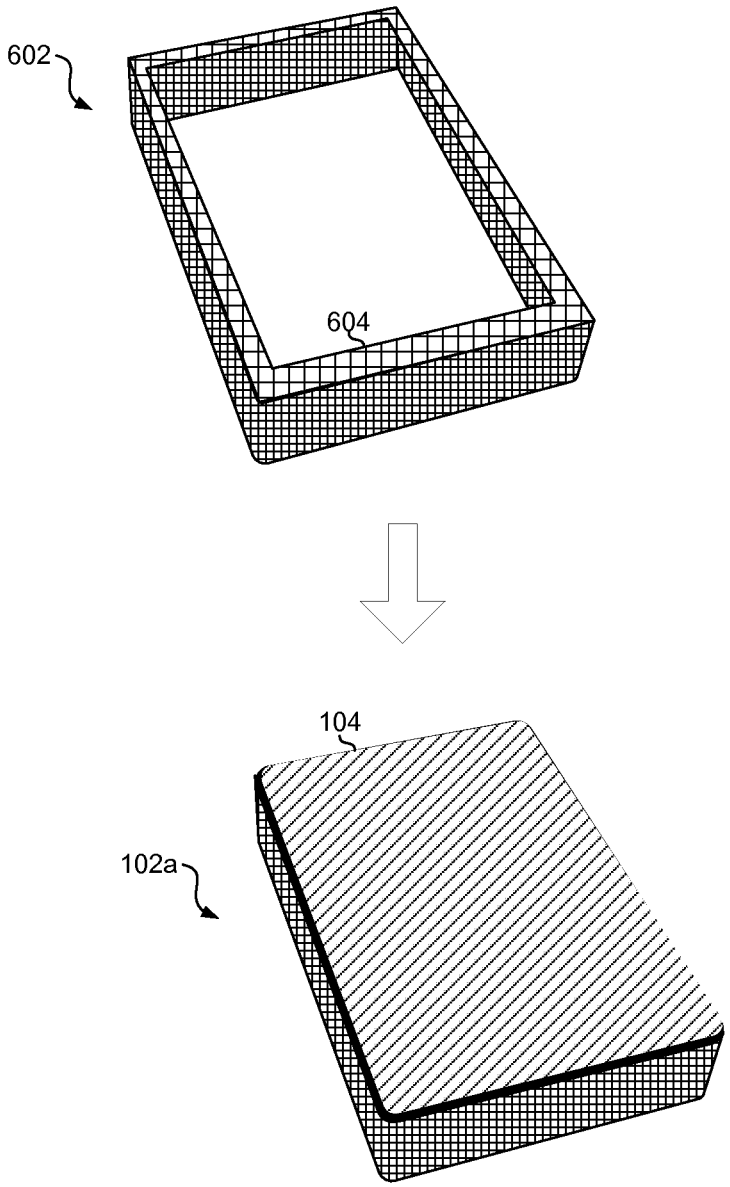
FIGS. 6A and 6B illustrate an ink cartridge comprising a trim ring.
Figure 6B:
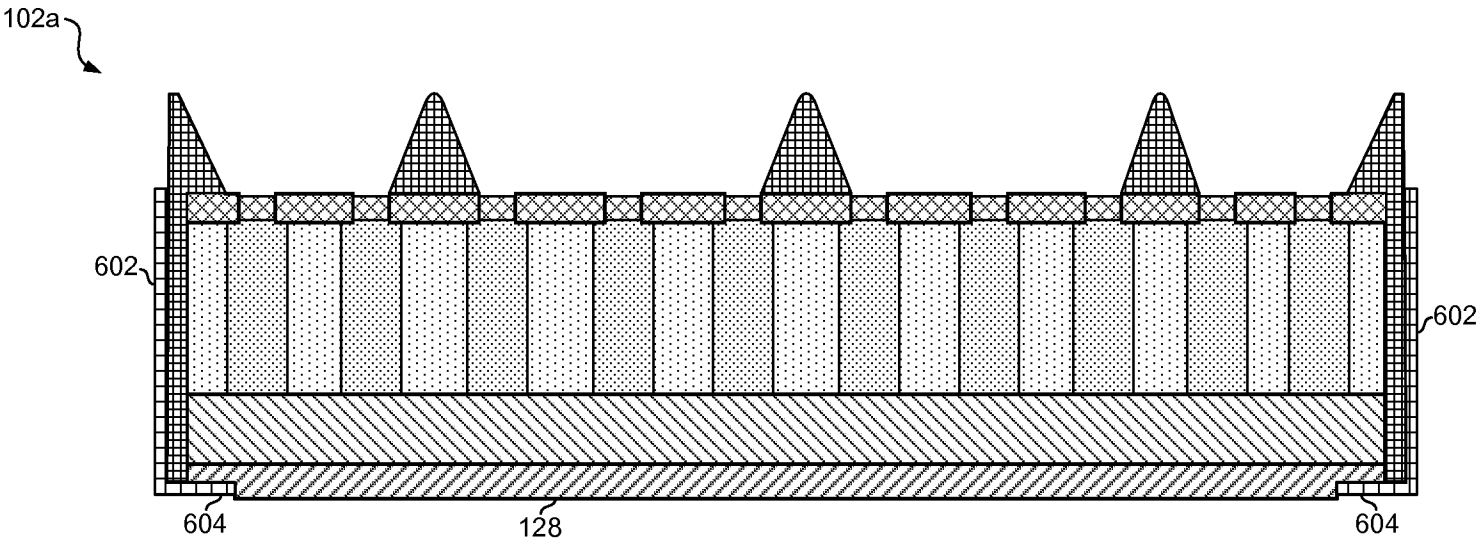

FIGS. 6A and 6B illustrate an ink cartridge comprising a trim ring. FIG. 6A shows the cartridge 102*a* (with the image forming component facing up) and a trim ring 604 that attaches to the frame 110 of the cartridge 102*a* to an image-forming component 104, the first ink-storage component 106, and/or the second ink-storage component 108 in place within the frame 110. That is, the lip 604 of the trim ring 602, rather than or in addition to adhesive) hold various components of the cartridge 102*a* together. For example, image-forming component 104 and the first ink-storage component 106 may be glued together but not to the second ink-storage component 108 or to the frame 110. For example, an example assembly of the cartridge may comprise: (1) inserting the component 108 into the frame 110 without gluing the component 106 to the frame 110; (2) gluing the components 106 and 104 together and then inserting the glued-together components 106 and 104 into the frame 110 without gluing them to the component 108; (3) snapping the trim ring 602 onto the frame 602 to hold the components 108, 106, and 104 to the frame 110. The trim ring 602 may, for example, slide over, under, and/or inside the wall of the frame 110.

FIG. 6B illustrates an example implementation where the image-forming component is retained by lip 604 of trim ring 602, and the image surface 128 protrudes below the lip 604 to enable stamping.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. An ink cartridge for a hand stamp, the ink cartridge comprising:

an image-forming component;

a first ink-storage component made of a first ink-absorbent material;

a second ink-storage component made of a second ink-absorbent material having pores configured to absorb ink, said second ink-storage component having a channel extending downwardly from an upper surface of said second ink-storage component, said channel having a plurality of subchannels open to one another, and each subchannel partially separated from the subchannel adjacent thereto by the second ink-absorbent material of said second ink-storage component, wherein said ink cartridge is configured to permit ink to pool in said channel until the ink is absorbed into one or more of said first and second ink-storage components; and a frame made of a rigid, non-ink-absorbent material, wherein:

said frame comprises a floor having a plurality of holes therein including a first hole, and a second hole spaced in a lateral direction from said first hole by said material of said frame, said floor having a top surface, the top surface sloping downwardly in said lateral direction towards said first hole, and sloping downwardly in a direction opposite from said lateral direction towards said second hole;

said frame comprises an outer wall along a perimeter of said frame, said outer wall extending up from said floor such that said outer wall is capable of retaining ink while said ink is being absorbed by said first ink-storage component and said second ink-storage component, thereby increasing the effective volume of said channel;

said frame is adhesively held to said second ink-storage component, said second ink-storage component is adhesively held to said first ink-storage component, and said first ink-storage component is adhesively held to said image-forming component; and said plurality of holes align with said subchannels of said channel such that ink is enabled to flow through said plurality of holes into said channel.

2. The ink cartridge of claim 1, wherein said frame comprises one or more retaining clips for attaching said ink cartridge to a stamp assembly.

3. The ink cartridge of claim 1, wherein said frame is configured to slide into a stamp and be retained via a groove in said stamp or said frame.

4. The ink cartridge of claim 1, wherein an inner surface of said outer wall is sloped such that the flow of ink is directed toward one or more of said plurality of holes.

5. The ink cartridge of claim 1, wherein said floor comprises one or more support ribs which are sloped such that the flow of ink is directed toward one or more of said plurality of holes.

6. The ink cartridge of claim 1, wherein said plurality of holes are uniformly distributed across said bottom of said frame.

7. The ink cartridge of claim 6, wherein said plurality of holes are arranged in a grid pattern.

8. An ink cartridge for a hand stamp, the ink cartridge comprising:

an image-forming component;

a first ink-storage component made of a first ink-absorbent material;

a second ink-storage component made of a second ink-absorbent material having pores configured to absorb ink, said second ink-storage component having one or more channels therein extending downwardly from an upper surface of said second ink-storage component, wherein said ink cartridge is configured to permit ink to pool in said one or more channels until the ink is absorbed into one or more of said first and second ink-storage components; and a frame made of a rigid, non-ink-absorbent material, wherein:

said frame comprises a floor having a plurality of holes therein;

said frame comprises an outer wall along a perimeter thereof, said outer wall extending up from said floor such that said outer wall is capable of retaining ink while said ink is being absorbed by said first ink-storage component and said second ink-storage component, thereby increasing the effective volume of said one or more channels;

said frame is adhesively held to said second ink-storage component, said second ink-storage component is adhesively held to said first ink-storage component, and said first ink-storage component is adhesively held to said image-forming component; and said plurality of holes align with said one or more channels such that ink is enabled to flow through said plurality of holes into said one or more channels wherein said frame comprises an inner wall extending parallel to said outer wall and said inner wall extending up from said floor such that said inner wall is capable of retaining ink while said ink is being absorbed by said first ink-storage component and said second ink-storage component, thereby increasing the effective volume of said one or more channels.

9. An ink cartridge for a hand stamp, the ink cartridge comprising:

a first component made of an ink-absorbent material and having one or more channels therein, said one or more channels defining a volume adjacent said ink-absorbent material, said ink-absorbent material being absent in said one or more channels;

a second component made of a rigid, non-ink-absorbent material, said second component comprising a floor, a wall extending up from said floor, and a plurality of holes in said floor including a first hole, and a second hole spaced in a lateral direction from said first hole by said material of said second component, said floor having a top surface, the top surface sloping downwardly in said lateral direction towards said first hole, and sloping downwardly in a direction opposite from said lateral direction towards said second hole, wherein:

said plurality of holes align with said one or more channels such that said plurality of holes overlie only said one or more channels, and ink is enabled to flow through said plurality of holes into said one or more channels and is enabled to pool in said one or more channels until absorbed by said ink-absorbent material; and said wall is arranged to retain ink while said ink is being absorbed by said first component.

10. The ink cartridge of claim 9, wherein said wall is sloped toward one or more of said plurality of holes such that a flow of ink on said second component is directed to said one or more of said plurality of holes.

11. The ink cartridge of claim 9, wherein said plurality of holes are uniformly distributed over said floor of said second component.

12. The ink cartridge of claim 9, wherein:

a bottom surface of said second component is adhesively held to a top surface of said first component; and a bottom surface of said first component is adhesively held to a third component of said ink cartridge.

13. The ink cartridge of claim 9, wherein:

said ink cartridge comprises a trim ring;

said second component comprises a frame; and said first component, and a third component of said ink cartridge are held to said frame by said trim ring.

14. An ink cartridge for a hand stamp, the ink cartridge comprising:

a first component made of an ink-absorbent material and having one or more channels therein, said one or more channels defining a volume adjacent said ink-absorbent material, said ink-absorbent material being absent in said one or more channels;

a second component made of a rigid, non-ink-absorbent material, said second component comprising a floor, a wall extending up from said floor, and a plurality of holes in said floor, wherein:

said plurality of holes align with said one or more channels such that ink is enabled to flow through said plurality of holes into said one or more channels and is enabled to pool in said one or more channels until absorbed by said ink-absorbent material; and said wall is arranged to retain ink while said ink is being absorbed by said first component, wherein:

said wall runs along an outer perimeter of said second component;

said second component comprises a second wall that runs along an inner perimeter of said second component; and said second wall is arranged to retain ink above the plurality of holes while said ink is being absorbed by said first component.

15. A method for loading ink into an ink cartridge for a hand stamp, the method comprising:

pouring ink onto a second component of said ink cartridge, wherein:

said ink cartridge comprises a first component and said second component;

said first component is made of an ink-absorbent material and having one or more channels therein defining a volume adjacent said ink-absorbent material, said ink-absorbent material being absent in said one or more channels;

said second component is made of a rigid, non-ink-absorbent material and comprises a floor, a wall extending up from said floor, and a plurality of holes in said floor;

said plurality of holes align with said one or more channels such that said ink poured onto said second component is enabled to flow through said plurality of holes into said one or more channels and is enabled to pool in said one or more channels until the ink is absorbed by said ink-absorbent material; and said wall is arranged to retain said ink poured on said second component while said ink is being absorbed by said first component, wherein:

said wall runs along an outer perimeter of said second component;

said second component comprises a second wall that runs along an inner perimeter of said second component; and said second wall is arranged to retain ink above the plurality of holes while said ink is being absorbed by said first component.

16. The method of claim 15, wherein said wall is sloped toward one or more of said plurality of holes such that a flow of ink on said second component is directed to said one or more of said plurality of holes.

17. The method of claim 15, wherein said floor is sloped toward one or more of said plurality of holes such that a flow of ink on said second component is directed to said one or more of said plurality of holes.

18. The method of claim 15, wherein:

a bottom surface of said second component is adhesively held to a top surface of said first component; and a bottom surface of said first component is adhesively held to a third component of said ink cartridge.

19. The method of claim 15, wherein:

said ink cartridge comprises a trim ring;

said second component comprises a frame; and said first component, and a third component of said ink cartridge are held to said frame by said trim ring.

20. The method of claim 15, wherein said ink-absorbent material of said first component has pores, wherein the pores of said ink-absorbent material of said first component are configured to absorb ink pooled in said one or more channels.

* * * * *